United States Patent [19]

Givens

[11] 3,945,906

[45] Mar. 23, 1976

[54] ANODE LINING SYSTEM

[75] Inventor: Travis R. Givens, Town Creek, Ala.

[73] Assignee: Reynolds Metals Company, Richmond, Va.

[22] Filed: June 6, 1974

[21] Appl. No.: 476,863

[52] U.S. Cl. ..... 204/245; 204/67; 204/243 R; 204/286; 204/290 R; 204/294; 313/327; 13/18

[51] Int. Cl.[2] ..... C25C 3/12; C25C 7/02

[58] Field of Search ..... 204/67, 243 R–247, 204/290 R, 286, 294; 313/327

[56] References Cited

UNITED STATES PATENTS

| | | | |
|---|---|---|---|
| 2,680,142 | 6/1954 | Graybeal | 204/290 R X |
| 2,769,113 | 10/1956 | Grayheal | 204/286 X |
| 3,509,030 | 4/1970 | Gooding | 204/286 X |
| 3,663,419 | 5/1972 | Toth et al. | 204/243 R |

FOREIGN PATENTS OR APPLICATIONS

| | | | |
|---|---|---|---|
| 134,026 | 6/1955 | U.S.S.R. | 204/245 |

*Primary Examiner*—T. Tung
*Assistant Examiner*—Aaron Weisstuch
*Attorney, Agent, or Firm*—Glenn, Palmer, Lyne, Gibbs & Clark

[57] ABSTRACT

An interior lining system for aluminum reduction cell anodes comprising strips of flexible sheet material supplied in roll form with adjacent strips disposed in laterally overlapping relationship between the anode and its casing.

3 Claims, 3 Drawing Figures

ANODE LINING SYSTEM

This invention relates to electrolytic cells of the type having a continuous self-baking anode. Such a cell commonly includes an anode casing peripherally enclosing the anode and defining its cross-sectional shape. The present invention is concerned especially with providing an interior lining between the anode and its casing.

BACKGROUND OF THE INVENTION

Aluminum reduction cells have traditionally employed anode systems of two different types: prebaked carbon blocks arranged in the cell for individual height adjustment and replacement, and Soderberg or self-baking anodes in which a large mass of carbonaceous material, typically a mixture of pitch and coke, is supported in a casing over the cell. In the latter system, the heat of operating the cell bakes the anode in place as it is formed progressively. Then, as the carbon anode is consumed at its lower end, more anode paste is supplied on top to replenish the anode. Adjustment of the anode position in the cell may be accomplished by lowering the anode and its casing as a unit, or by lowering the anode within its casing, or combinations of both.

Some cells use a permanent anode casing which is mounted in fixed relation to the cell. This type of construction typically includes external support means for the permanent casing, such as removable channels or the like, and a jacking system for adjusting the anode position within the casing. One such arrangement, particularly for Soderberg cells having side-entry anode pins, includes a stack of channel members on opposite sides of the anode, with clearance holes for the pins. The fixed casing itself has corresponding slots that are elongated vertically to allow for lowering the anode with its electrical contact pins and their associated support channels as a unit relative to the anode casing. Before the lowermost channels come too close to the bath, the bottom row of support channels and associated anode pins can be removed and later reset at the top.

SUMMARY OF THE INVENTION

In order to achieve the necessary slippage between the anode and its casing when adjusting their relative positions, various lining materials have been interposed between the anode and casing. The present invention provides an improved lining system for that purpose. The lining is formed by laterally overlapping strips of flexible sheet material supplied in continuous lengths from rolls thereof that are arranged to unwind and move with the anode as it is lowered within the casing. An advantage of this arrangement is that the rolls of lining material have to be replaced only at infrequent intervals, thus minimizing the maintenance effort. In addition, when the rolls are supported on an interior surface of the anode casing, for example, the supply of rolled lining strips can be enclosed with the anode under a removable cover. The cover affords access for introducing anode paste, or replacing the rolls periodically, and it also serves to keep alumina ore at the cell from dusting out on the anode.

The lining material used may be sheet steel or aluminum, for example, of a thickness suitable for coiling into a compact roll, and preferably thin enough to allow for punching anode pins through the lining. Other conventional nonmetallic sheet materials used for anode linings can also be employed, if they are strong enough and provide sufficient adhesion to the carbon anode, but sheet metal is preferable for cells having anodes equipped with side-entry pins entering the anode through the lining, in order to achieve positive feeding of the strip as it unwinds from the roll. Common sheet steel of a thickness in the range of about 0.005–0.010 inch ordinarily is suitable for this purpose.

DETAILED DESCRIPTION

The present preferred embodiments of the invention are illustrated in the accompanying drawings, wherein.

Figure 2:
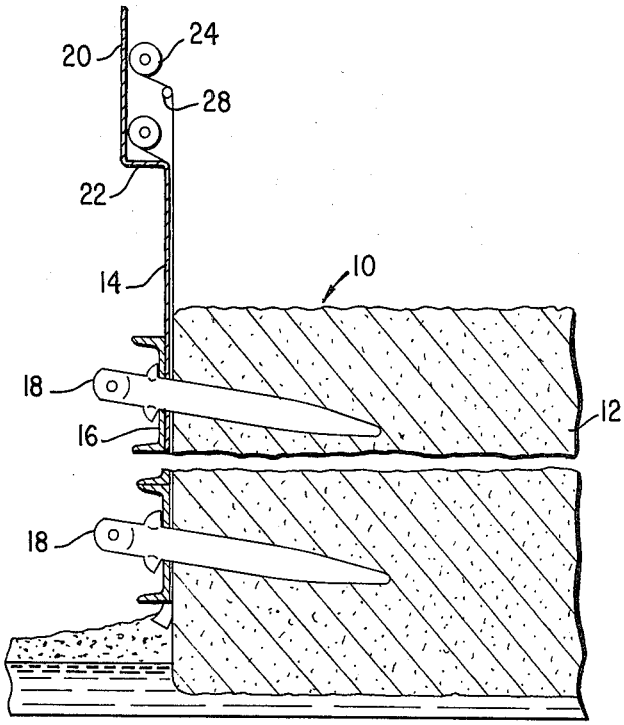
FIG. 2 is a partial transverse section through an anode of the cell.

Referring to FIG. 2, the anode assembly 10 includes a continuous self-baking anode 12, permanent casing means 14 and support channels 16 having clearance holes for the side-entry anode pins 18. The casing means 14 include an outwardly spaced upper portion 20 extending above the anode, and a shelf-like connecting portion 22.

Figure 3:
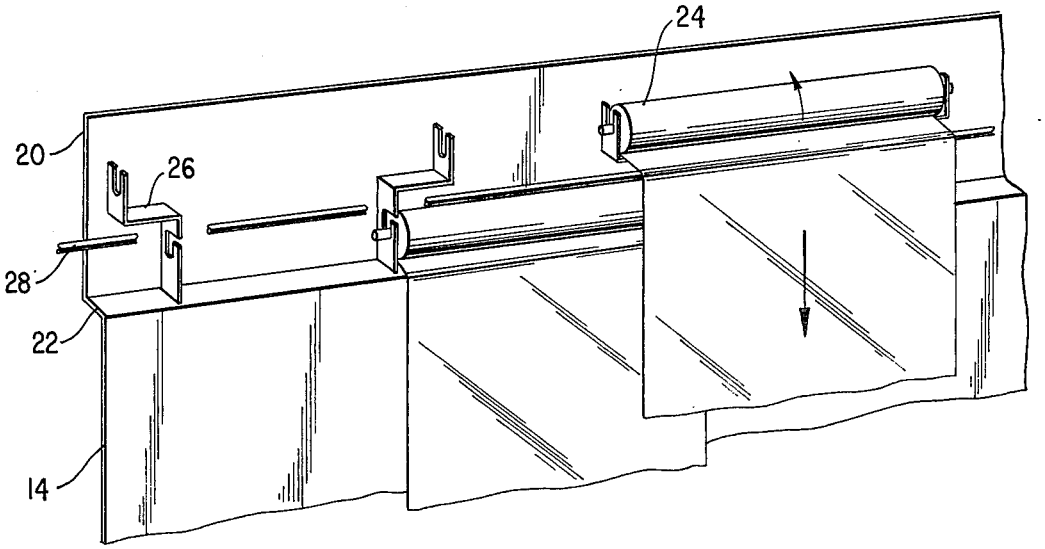
FIG. 3 is a partial interior elevation of the anode casing and associated components of the lining system.
Figure 4:
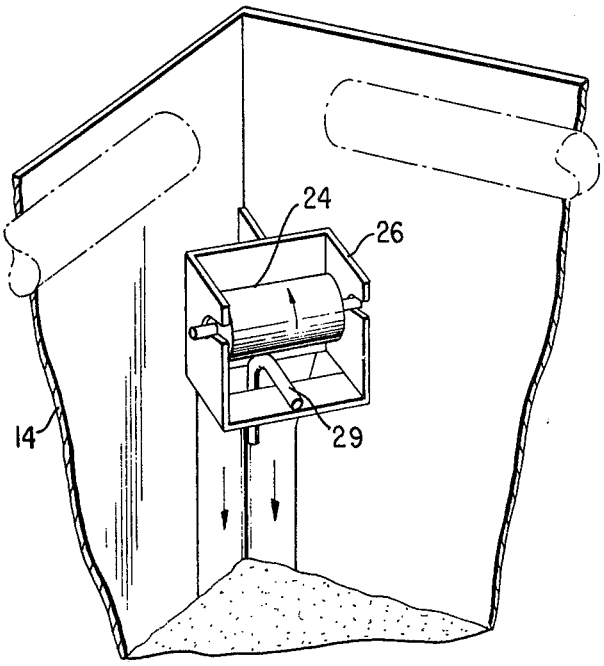
FIG. 4 is a partial interior elevation at a corner of the anode casing.
Figure 5:
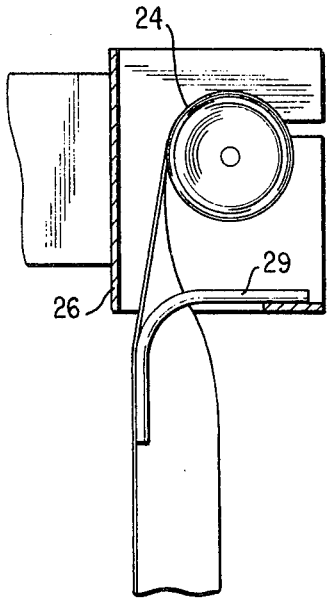
FIG. 5 is a vertical section of the anode casing at a corner thereof.

As detailed in FIGS. 3, 4 and 5, strips of flexible sheet metal lining material are supplied in continuous lengths from rolls 24 that are supported by brackets 26 mounted on the anode casing. The rolls are placed alternately one above the other along opposite sides of the anode, in order to allow for unwinding the strips from adjacent rolls in a common pass line with their edges overlapping. Each of the rolls is arranged to unwind inwardly from beneath the roll, thence around an edge of the connecting portion 22 of the anode casing, or an upper guide rod 28 similarly situated, and downwardly along an interior surface of the anode casing. This arrangement for feeding the strips provides sufficient drag to keep the rolls from unwinding prematurely, without imposing any appreciable tension in the strips or interfering with their movement downwardly within the casing.

Additional anode lining strips are similarly arranged in laterally overlapping relationship along opposite ends of the anode. Rolls of corner strips are mounted for rotation on a diagonal axis adjacent each corner of the anode, and a guide rod 29 is provided for folding each corner strip as it leaves the roll to form side and end portions of the strip overlapping the adjacent side and end strips.

To form the lining initially, the overlapping strips are placed within the anode casing and held in position by introducing anode paste on top of the anode. At an appropriate stage, the anode pins are punched through the lining into the anode. Thereafter, as the anode is formed progressively and lowered from time to time relative to the casing, the strips unwind from their rolls and move downwardly through the casing along with the anode, and eventually are melted into the molten contents of the cell as the anode is consumed.

Figure 1:
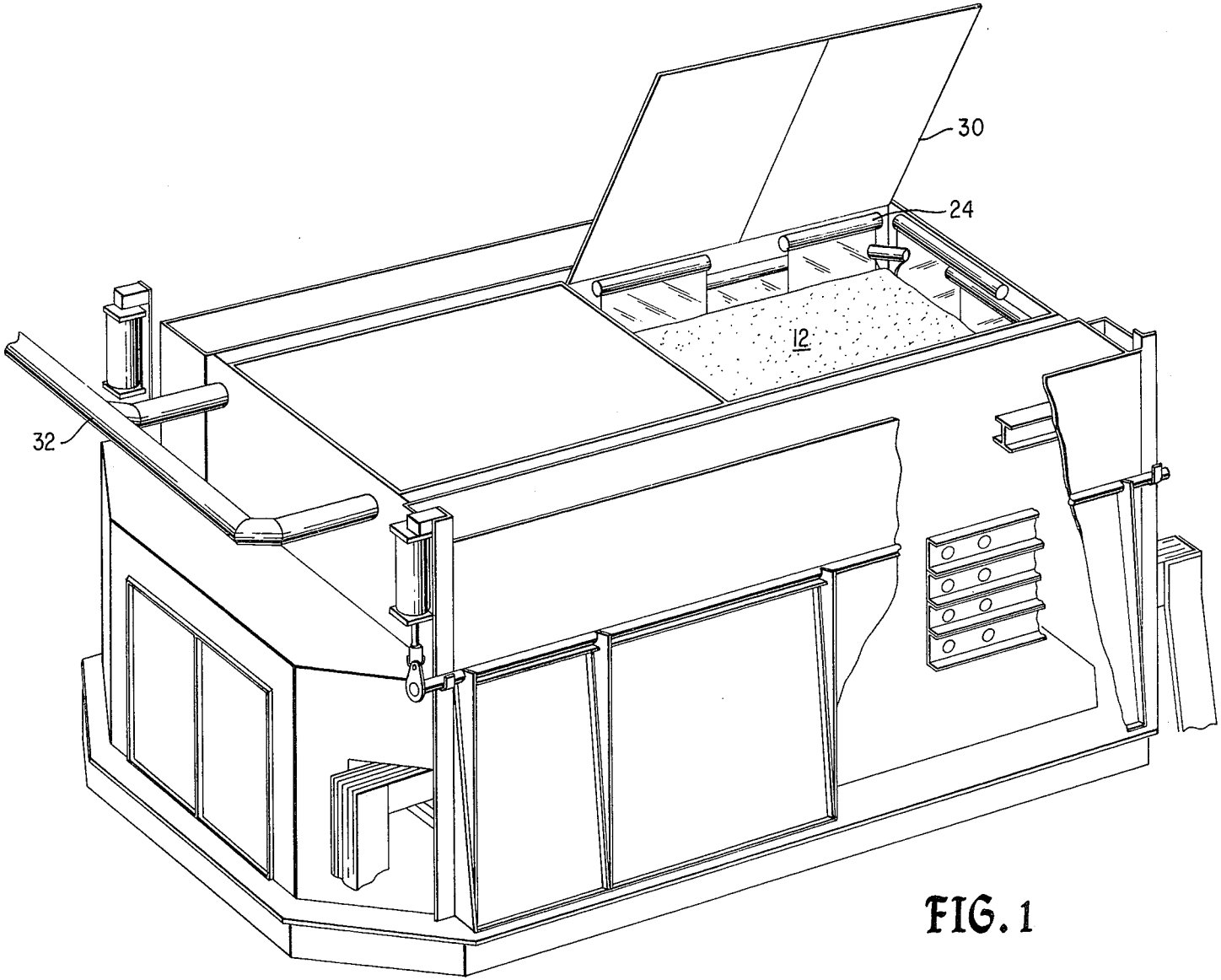
FIG. 1 is a semi-schematic perspective view of an aluminum reduction cell.

In the general arrangement of the cell shown in FIG. 1, it can be seen that the anode 12, its permanent casing 14 and the rolls 24 of lining material are enclosed by hinged doors 30 arranged to provide access for anode servicing operations. Also, the entire cell is generally enclosed as shown, to provide for collecting gaseous effluent of the cell through take-off ducts 32.

Figure 6:
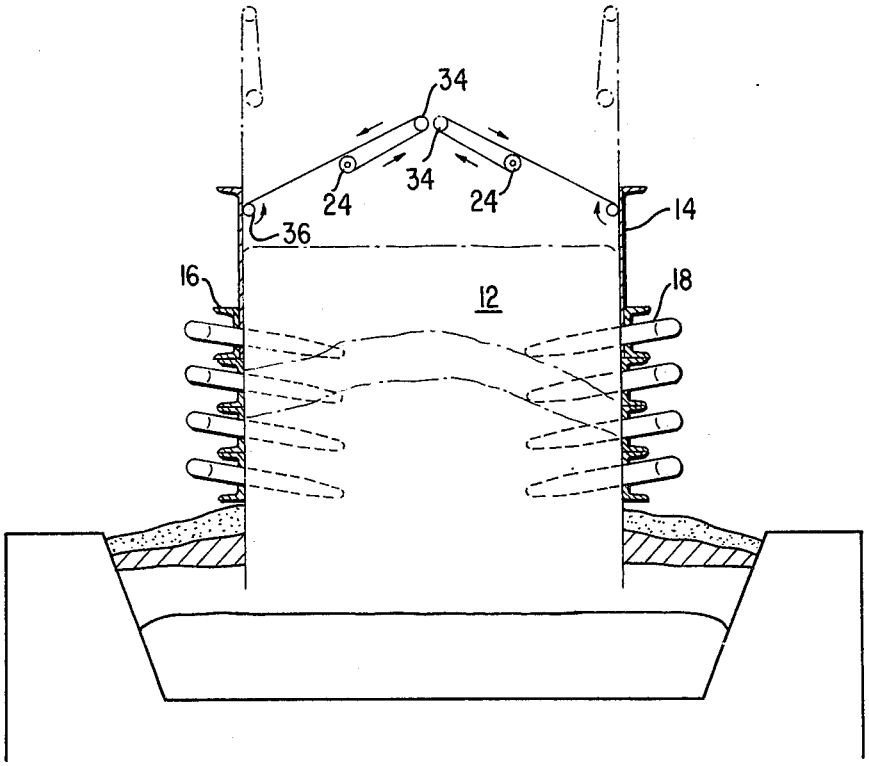
FIG. 6 is a transverse section of a cell showing an alternative embodiment of the anode lining.

An alternative cover arrangement is shown in FIG. 6, where the supply rolls 24 of lining material are supported on framework above the anode. As the laterally overlapping strips are supplied from these rolls they are passed upwardly over guide rollers 34, thence downwardly over cover pivot hinge rollers 36 adjacent the anode casing to form an inner lining previously described. However, in this embodiment, the strips also constitute a cover for the anode and its casing. Access is provided by swinging either or both halves of the cover upwardly about the axis of rollers 36 to the raised positions shown in dotted lines.

Although presently preferred embodiments of the invention has been illustrated and described, it will be apparent that the invention may be otherwise variously embodied and practiced within the scope of the following claims.

What is claimed is:

1. In an aluminum reduction cell having a continuous selfbaking anode of substantially rectangular shape, permanent casing means for the anode, support means for the casing means, a plurality of side entry electrical contact pins entering the anode on opposite sides thereof through clearance holes in the support means and corresponding slots in the casing means, the slots being elongated vertically to allow for adjusting the anode position within the casing means, and an inner lining for achieving a slippage between the anode and the casing means when adjusting their relative positions, the lining being disposed between the anode and the casing means along each anode side and end and having the contact pins punched through the portions thereof along each anode side, the improvement wherein:

the lining is formed from a plurality of strips of flexible sheet material which extend downwardly between the anode and the casing means, with adjacent strips in laterally overlapping relationship, there being a plurality of side strips for each anode side, at least one end strip for each anode end and one corner strip for each anode corner; and the lining is supplied in continuous lengths by a rotatably mounted roll of said sheet material for each of said strips, the rolls respectively associated with side and end strips being placed to provide for feeding adjacent strips along a common pass line with their edges overlapping, each roll associated with an anode corner strip being mounted for rotation on a diagonal axis and including means for folding said strips as it leaves said roll to form side and end portions of said strip which overlap the adjacent side and end strips.

2. The improvement of claim 1 wherein said rolls are mounted alternately one above the other.

3. The improvement of claim 2 including cover means for affording access to the upper interior of the casing means to replace said rolls and replenish the anode, said rolls being supported on and within the casing means and beneath said cover means.

* * * * *

PO-1050
(5/69)

UNITED STATES PATENT OFFICE

CERTIFICATE OF CORRECTION

Patent No. 3,945,906 Dated March 23, 1976

Inventor(s) Travis R. Givens

It is certified that error appears in the above-identified patent and that said Letters Patent are hereby corrected as shown below:

Column 4, lines 24-26, that portion of claim 1 reading "folding said strips as it leaves said roll to form side and end portions of said strip which overlap the adjacent side and end strips." should read -- folding said corner strip as it leaves said roll to form side and end portions of said corner strip which overlap the adjacent side and end strips. --

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*